US006261090B1

(12) United States Patent
Boswell et al.

(10) Patent No.: US 6,261,090 B1
(45) Date of Patent: Jul. 17, 2001

(54) GAS COMBUSTOR AND COMBUSTOR SYSTEM FOR COMBUSTION OF SMOKE, OFF GASES AND OTHER EMISSIONS

(75) Inventors: John J. Boswell, Palm Beach Gardens, FL (US); Dale R. Eichmeyer, Lebanon, MO (US)

(73) Assignee: Independent Stave Company, Lebanon, MO (US)

( * ) Notice: Subject to any disclaimer, the term of this patent is extended or adjusted under 35 U.S.C. 154(b) by 0 days.

(21) Appl. No.: 09/561,320

(22) Filed: Apr. 28, 2000

Related U.S. Application Data

(60) Provisional application No. 60/149,273, filed on Aug. 17, 1999.

(51) Int. Cl.[7] ..... F23J 17/00

(52) U.S. Cl. ..... 432/72; 432/120; 110/203; 110/204; 110/205; 110/206; 110/210; 110/211; 110/254

(58) Field of Search ..... 432/120, 72; 110/203, 110/204, 205, 206, 207, 210, 211, 214, 254, 302, 304, 303, 308; 122/1 A, 20 B, DIG. 1 A, DIG. 1 B; 126/80, 307 R, 312, 208; 237/55

(56) References Cited

U.S. PATENT DOCUMENTS

| | | | |
|---|---|---|---|
| 4,312,278 | 1/1982 | Smith et al. . | |
| 4,334,484 | 6/1982 | Payne et al. . | |
| 4,850,288 | 7/1989 | Hoffert et al. . | |
| 5,279,234 | 1/1994 | Bender et al. . | |
| 5,313,894 * | 5/1994 | Ishikawa | 110/210 |
| 5,516,499 * | 5/1996 | Pereira et al. | 110/210 |

* cited by examiner

*Primary Examiner*—Jiping Lu
(74) *Attorney, Agent, or Firm*—Peter S. Gilster; Greensfelder, Hemker & Gale, P.C.

(57) ABSTRACT

A combustor system provides high temperature, high-dwell combustion of emission products, as from charcoal kilns, with inner and outer combustion chambers. Multiple inlets receive emission products from multiple heat exchangers omnidirectionally extending for continuous heat exchange connection between the combustor and emission sources. Hot products of combustion are delivered to each heat exchanger, each with multiple ducts in mutual heat exchange relationship including at least a hot products of combustion duct for receiving at the proximal end hot products of combustion from an outlet of the outer chamber, and conveying the hot products of combustion to the distal end at a respective emission source, an emissions inlet duct for receiving emission products at the distal end from the emission source, and a return products of combustion duct for receiving at the distal end the hot products of combustion and returning them to the combustor. The heat exchanger arrangement is such that the hot products of combustion duct and the return products of combustion duct cause heating of the emission products by the heat exchange relationship. A combustion air intake passage provides intake of combustion air for each heat exchanger, which mixes in the combustion chamber with the emission products. Combustion products pass cyclonically from the inner chamber and then by reversal of direction, i.e., from downward to upward, through a concentric outer chamber, to create hot products of combustion which exit into the heat exchangers.

20 Claims, 6 Drawing Sheets

GAS COMBUSTOR AND COMBUSTOR SYSTEM FOR COMBUSTION OF SMOKE, OFF GASES AND OTHER EMISSIONS

CROSS REFERENCE TO RELATED APPLICATION(S)

This application claims benefit of provisional appl No. 60/149,273 Aug. 17, 1999.

BACKGROUND OF THE INVENTION

The invention relates to improvements of the apparatus and methods of the present inventors set forth in provisional patent application Ser. No. 60/095,054 filed Aug. 3, 1998, entitled COMBUSTORS AND BURNERS WITH HIGH TURNDOWN RATIO, incorporated herein by reference, continued preservation of which is requested.

FIELD OF THE INVENTION

The invention is in the field of industrial burners, combustors and incinerators and, more particularly, relates to a new combustor and combustor system for combustion of smoke and other combustible off-gases and other emissions produced in the operation of charcoal kilns and other processes, as in wood products manufacturing or processing operations.

Charcoal is made by both continuous and batch processes which carry out partial combustion of wood, e.g., hardwood and/or wood waste, sawdust, agricultural products, bagasse, biomass, poultry waste, and other mixtures of various carbonaceous or cellulosic materials. A well-known example of batch process for charcoal manufacture involves the use of kilns, or arrays of kilns to which products are charged, combusted and then retrieved as charcoal lumps and/or fines.

Charcoal production from wood involves the thermal degradation of wood in a starved-air atmosphere. In a kiln, pyrolysis and combustion both occur in self-sustaining reaction. Heat required for pyrolysis is supplied from the combustion reactions which are exothermic. Kilns of this type are not subjected to or pressure control or to precise temperature control. These batch process kilns operate discontinously. They have typical charcoal yields generally only 20–30%, and accordingly much mass and heat are lost by combustion and with accordingly high liberation and emission of smoke, gas and constituents.

Such kilns can emit pollutants in the form of smoke and hot gas emissions including particulate matter (PM), volatile organic compounds (VOC) and possibly toxic compounds such as certain polyaromatic hydrocarbons (PAHs) in the form of combustible off gases and other emission products. Among the possible emission products of carbonaceous combustion occurring in such kilns is carbon monoxide, a pervasive atmospheric contaminant.

For pollution prevention, it is desired to provide further burning combustible off-gases and other emission products, including VOCs, PAHs and particulate matter, to prevent potential atmospheric contaminants and other untreated emission products produced in kiln operation by treating them before they are allowed to be released to the atmosphere.

Other combustion processes and devices used in processing of wood products similar may produce smoke, combustible gases particulates, VOCs, PAHs and particulate matter and other emission products. These include primary burners and incinerators, and may also include various processes and devices which release industrial off-gases. For example in the wood products industry, as also the production of charcoal, there is a need also for dealing with smoke and other gases and other potential contaminants and other emission products which might be produced during operations. For example, in cooperage operations where barrels are produced for aging of beverages, such as wines or brandies, etc., some types of barrels require that they be charred, as for the aging of various kinds of whiskeys. Charring operations produce smoke which may need to be combusted.

All such kiln emissions and other gaseous products, including without limitation kiln smoke and other gaseous products and off-gases and other emissions or emission products from combustion processes, will herein be referred to for convenience as "emissions" or "emission products." As used for convenience herein, the term emission or emission product also connotes, without limitation, gases and gaseous products and off-gases produced not primarily as fuels but instead emitted, liberated or created by other processes and apparatus, including smoke and other gases as well as VOCs, PAHs and particulate matter and other emission products produced by kilns, burners and other apparatus in which partial or contaminant-producing combustion occurs under conditions producing smoke or other gases or other emissions.

Such emissions as may be sources of environmental pollution can advantageously be combusted, i.e., by oxygenation combustion. Such emissions (including their related products and reaction products) are in the typical usages described above capable of further combustion before release to the atmosphere.

Combustion apparatus of the present invention, hereinafter referred to for convenience simply as "combustor" or "combustors" or "combustor system" is intended to provide high temperature oxygenation combustion of emissions. Specifically combustors and combustor systems of the invention operate with high turndown ratios and high heat release ratios.

RELATED ART

With regard generally to reactions occurring in charcoal production, the following papers are generally relevant to of reactions and compositions released during the manufacture of charcoal but are not believed relevant to constructions presently disclosed and claimed.

Di Blasi, C., 1993, Analysis of Convection and Secondary Reaction Effects within Porous Solid Fuels undergoing Pyrolysis. Combust. Sci. Technology 90, 315–339.

Hajaligol, M. R., Howard, J. B., Longwell, J. P., Peters, W. A., 1982, Product Compositions and Kinetics for Rapid Pyrolysis of Cellulose. Ind. Eng. Chem. Process Des. Dev. 21, 457–465.

Shafizadeh, F. and Chin, P. P. S., 1977, Thermal deterioration of wood. ACS Symp. Ser. 43, 57–81.

In the general field of burners, combustors and incinerators for industrial purposes, there are myriad different configurations, wherein there has for many years been an increasing focus on efficiency and output. Thus, there have been proposals for swirling or cyclonic combustion and combustion chambers of unusual geometries, as well as many proposals for controlling the entry of air and fuel into the combustion chamber for contributing to swirling or other patterns of combustion motion. There have been various burners proposed for burning, as feed stocks, organics or biomass materials, including so-called green (high moisture content) sawdust, solid cellulosic or wood-containing waste, waste wood, and fragments of wood, and all of which may herein be referred to as wood products. And, burners of various configurations and capabilities have been proposed for combustion of emissions.

In burners useful for burning such materials, there has been insufficient emphasis on achieving efficiency and flexibility which can result from achieving a high turndown ratio (which may for convenience be abbreviated "TDR"), which is the maximum firing rate of the burner divided by the minimum firing rate of the burner. Prior constructions have not achieved sufficiently high TDRs.

The provision of a high TDR for a combustor capable of carrying out combustion of emissions and their related constituents is highly desirable, as such a combustor would be capable of being operated over a very substantial dynamic range. If the use of a burner having a limited TDR requires that burner operation be terminated if off-gas supply rates are insufficient to achieve the minimum firing rate of the burner, utility of the burner will be undesirably limited. Or, combustion of emissions at low feed rates is to be carried out, may require use of an auxiliary fuel such as natural gas, liquefied petroleum (LP) gas, propane, or fuel oil for maintaining combustion. But, on the other hand, if a burner is designed for burning emissions at low feed rates, its output may be insufficient to handle high feed rates when wood products to be combusted are being produced at high volumes.

Present burners in the wood products industries have not met the needs for these kinds of combustion, and have not achieved satisfactory TDR and efficiencies for acceptable usage in the wood products industries.

In connection with use of the present combustor and combustor system with charcoal production, batch-type charcoal kilns are often distributed widely at a production facility. The combustor system is highly advantageous for use in such a facility. It uses heat exchanger components which extend to each of several kilns at such a facility and in which the process of heating emissions from these kilns for combustion of the emissions commences substantially at the point at which the emissions are discharged from the kilns, and without permitting such emissions to be discharged to the atmosphere.

The problem of emission products control at a charcoal kiln facility is compounded by the disparate, random, distributed or otherwise site-specific location of the multiple kilns, each kilns or arrays of kilns being a separate and distinct source of emission products. Kiln emissions could, of course, be subjected to further combustion. If, for that purpose, emissions were merely drawn into ducts and then drawn away to a gas burner or other combustor, it is likely that the kiln gases would cool, and that smoke, volatiles and constituents would condense in the ducting or be deposited in the ducts. Therefore, it is believed desirable to provide, as in the present invention, a system in which sources of emission products where heat exchange relationship with emission products is initiated at a location proximate a point of discharge of the emission products at the sources, no matter how separate, disparate or distributed, or sited, so that the emission products are not cooled, but rather are only further heated and may then be readily combusted at very high temperatures so as to be rendered harmless.

With regard generally to burners, incinerators or devices for the combustion of gases, the following U.S. patents are noteworthy:

Bender et al. U.S. Pat. No. 5,279,234 describes a biomass fuel gasification/combustion system wherein there is evidently cyclonic flow in a combustion chamber. In a first chamber, fuel is heated in an anaerobic manner for pyrolysis, and such flow proceeds from the first chamber into a blast tube which constitutes a secondary combustion chamber.

Hoffert et al. U.S. Pat. No. 4,850,288 describes the use of a cyclonic combustion pattern is obtained by introducing particulate solids such as wood chips tangentially into a primary combustion chamber. The output of the primary chamber passes through a choke into which quench air is introduced and then into a secondary combustion chamber.

Payne et al. U.S. Pat. No. 4,334,484 discloses a biomass gasifier combustor for biomass fuels auger-fed into a primary combustion chamber. Combustion-produced flow then is provided to a secondary combustion chamber in which a propane source brings about further combustion.

Smith et al. U.S. Pat. No. 4,312,278 reveals a chip wood furnace in which wood chips or fuel fragments are trickle fed into a combustion chamber which is fueled by an oil burner. In addition, other wood wastes and products can be burned.

None of these references discloses a combustor or system suited or useful for providing a system having a central combustor which is interactive with heat exchange devices in an arrangement providing heat exchange relationship with emission products provided by multiple sources of emission products, or to an arrangement especially suitable for use with charcoal kilns, or for use in combusting emission products to another system in which sources of emission products the are disparate or distributed, or where a heat exchange relationship with emission products is desired to be initiated at a location proximate a point of discharge of the emission products at the sources. The present invention contrasts with such references, e,g, in which there is gassification of wood products, a highly exothermic process giving off great quantities of heat. The present combustor system, by comparison, is capable of burning emission products given off at far lower temperatures, as typical of kiln emissions.

SUMMARY OF THE INVENTION

Accordingly, among the several objects, features and advantages of the invention may be noted the provision of a novel combustor and combustor system for combustion of gaseous, smoky emissions, or other gases and emission products which be oxygenated or burned for conversion to an environmentally non-polluting condition.

As used for combustion of gaseous, smoky emissions and other emission products, constructions and methods of the presently claimed invention are of special utility and economical suitability for efficiently burning emissions such as charcoal kiln emissions in situations where other processes and apparatus have produced gases which are amenable to further combustion and which by combustion at relatively high temperatures and with desirably high dwell times may be rendered may be converted to a safer state or effectively destroyed.

The present invention specifically proposes improved gas combustors and combustor systems of high utility in charcoal production, being especially useful for combustion of emissions from charcoal kilns, and being also otherwise useful for combustion of emissions produced in connection with burning or charring of wood products and biomass combustion.

The invention is not limited for use in combustion of emissions, smoke and other emissions from the foregoing industries, but is useful for combustion of emissions from myriad other processes, devices and systems, which may produce smoke and other particulate matter including dust.

The inventive combustors and combustor systems can be integrated into installations having charcoal kilns or other types of systems having discharge of by-products or exhaust streams of combustible emissions, as in wood products industries, where emissions may result from the partial combustion of cellulosic materials including wood and other organic materials.

The invention also relates to the provision of such systems and combustors of high efficiency and flexibility, and particularly operating over a wide dynamic range.

The invention also relates to the provision of such combustors and combuster systems which can be used in operation on continuous basis or for longer periods of operation, and at greatly variable output different as may be desired.

The invention also relates to the provision of such systems and combustors achieving high TDRs in operation, so that much less auxiliary fuel will be required to initiate combustor operation. Even more desirably, increase of TDR as according to the present invention may permit operation of a combustor without using an auxiliary fuel after start-up.

The invention also relates to the provision of such systems and combustors capable of operation so efficient that they may not require auxiliary burners during normal operation following start-up.

The presently inventive combustors and combustor systems have advantageous intrinsic capability for being scaled to emission combustion requirements, as according to the intended mode of usage and industry segment in which the combustors are to serve. So also, combustor systems of the invention are advantageously and readily able by design for configuration appropriate for use at sites having distributed kiln or other emission sources. The new combustor systems may thus adapt to the site layout, spacing and topology of industrial installations which they are intended to serve.

A further advantage of the inventive combustors and combustor systems is their use of electronic controls using programmable logic controllers, for achieving precise, efficient, safe and reliable control and operation in all modes of usage.

In addition, burners of the present invention are economical in construction and operation.

Briefly, the present invention relates to a combustor system for high temperature, high-dwell combustion of emission products by connection to multiple sources of emission products, such as charcoal kilns, where the emission products are kiln emissions. The system comprises, or consists of, or consists essentially of, a combustor defining an internal combustion chamber for combustion of emission products, an inlet for receiving emission products to be combusted in the chamber, and a hot products of combustion outlet for providing outward flow of hot products of combustion from the combustion chamber, a plurality of heat exchangers each connected to the inlet, each heat exchanger being connected to at least one source of such emission products, and extending between the combustor and source of emission products for providing connection between the combustor and each source of emission products. The heat exchanger has a proximal end for connection to the combustor and a distal end for connection to the a source of emission products. Each heat exchanger includes multiple ducts in mutual heat exchange relationship including at least a hot products of combustion duct for receiving at the proximal end hot products of combustion from the hot products of combustion outlet, and conveying the hot products of combustion to the distal end, an emissions inlet duct for receiving emission products at the distal end from the source of emission products, and a return products of combustion duct for receiving at the distal end the hot products of combustion and returning them to the combustor. The heat exchanger arrangement is thus such that the hot products of combustion duct and the return products of combustion duct both provide transfer of heat for heating of the emission products by said heat exchange relationship. A combustion air intake passage provides intake of combustion air which is mixed in the combustion chamber with the emission products provided by the emission products duct to provide mixed combustion products into the combustion chamber for high temperature combustion therein. The combustor being configured for flow of combustion products passing therein, preferably through a first, inner chamber and then by reversal of direction through a concentric outer chamber, to create hot products of combustion. A circulation means, preferably a variable-speed fan, is used with a annular plenum, i.e., a collector ring to create a partial pressure within the system for causing emission products to be drawn into the emission inlet duct at the distal end from the source of emission products, and means for exhausting the return products of combustion after they have flowed through each such heat exchanger.

Other objects and features will be in part apparent and in part pointed out below.

BRIEF DESCRIPTION OF THE DRAWINGS

Corresponding reference characters indicate corresponding parts throughout the several views of drawings.

DETAILED DESCRIPTION OF PRACTICAL EMBODIMENT

Figure 1:
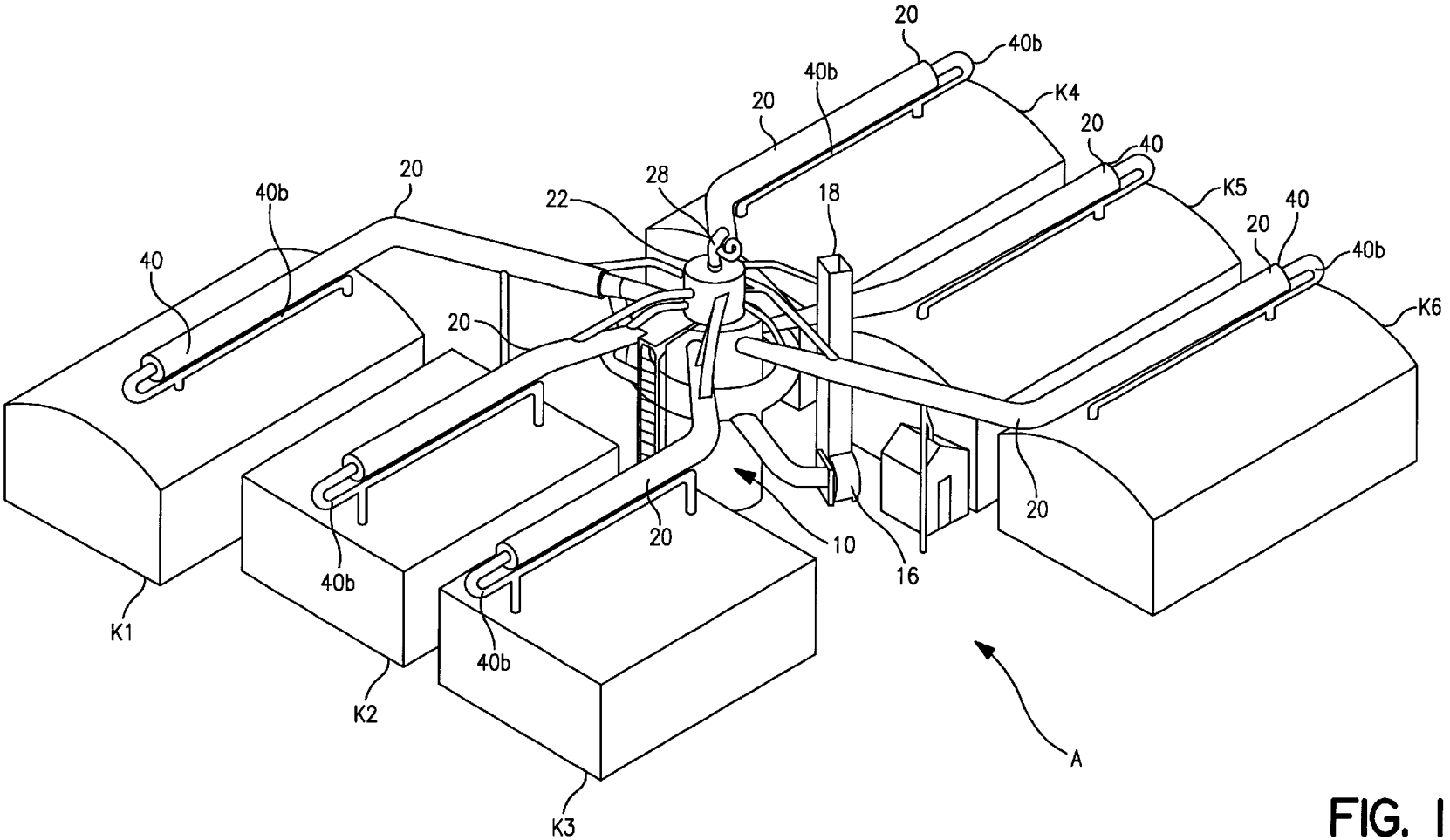
FIG. 1 is an overhead perspective view of a charcoal production facility in which there is illustrated the installation of a combustor system in accordance with and embodying the present invention.

Referring to FIG. 1 a so-called smoke combustor system of the present invention, designated in its entirety generally by reference character A is shown installed at a charcoal production facility where there are batch-type charcoal kilns K1–K6 each representing a source of kiln smoke and other off-gases, including particulate matter to be treated by high-temperature, high-dwell combustion in the new combustor system which has a centrally located smoke combustor identified in this description and generally indicated as combustor 10 which includes heat exchangers 20 extended to, and connected to, kilns K1–K6. Other features in this figure will be evident from the following description.

Figure 2:
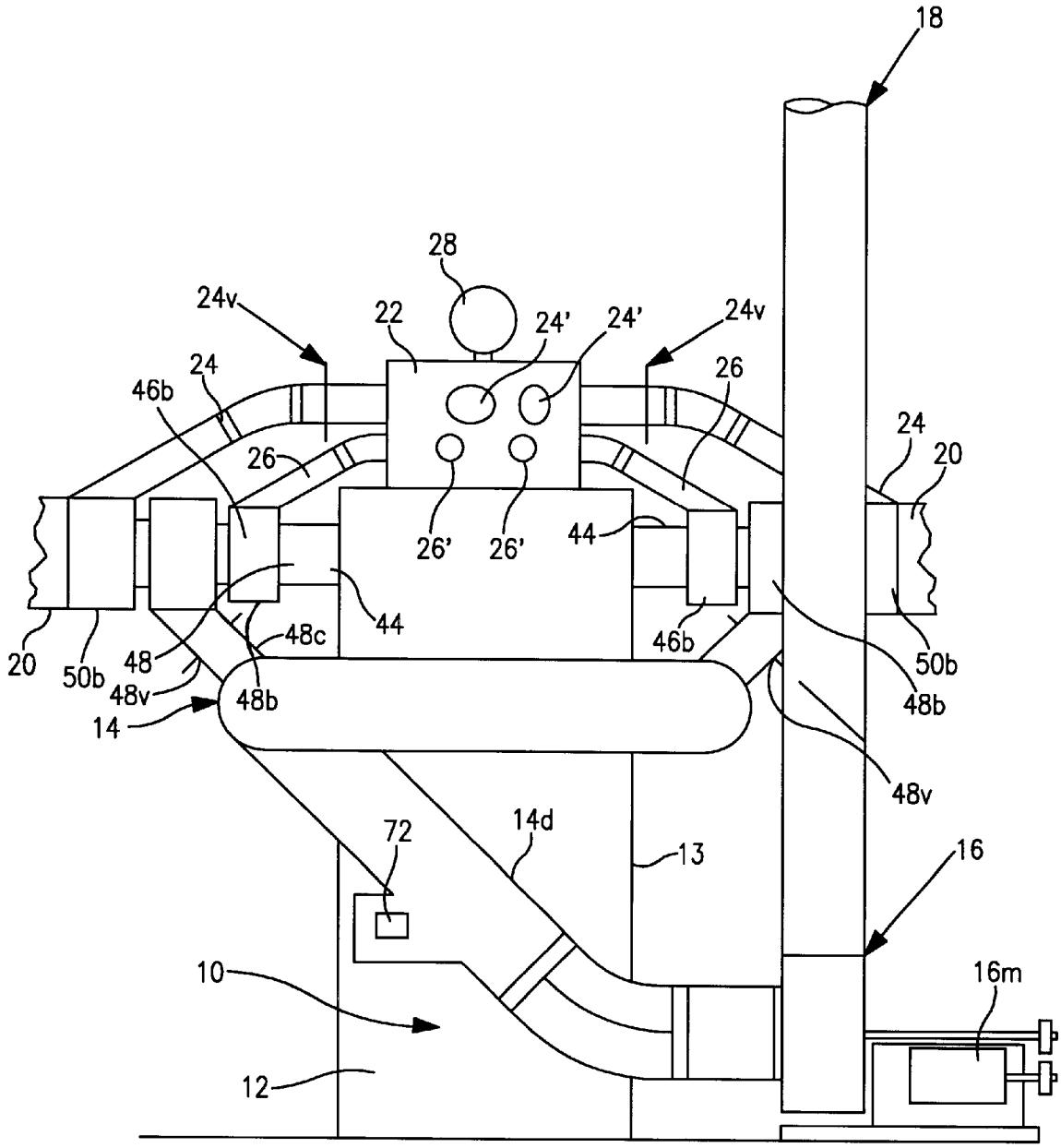
FIG. 2 is a vertical elevation, partly cut away and with symbolic representation of various elements, of a combustor forming part of the combustor system of FIG. 1.

Referring to FIG. 2, combustor 10 has a generally symmetrical housing 12 within which are located central heating, i.e., combustion, chambers described below. Housing 12 includes a steel outer shell 13 insulated, as described below, from the combustion chambers.

Surrounding the combustor is a collector ring 14 (hereinbelow called RPOC collector ring) of large diameter tubing. RPOC ring 14 serves in effect as a plenum used for collecting return products of combustion (RPOC) and for supplying them to an induced draft (ID) variable speed fan 16 which provides its output to an exhaust stack 18. The ductwork evident in the drawing is representative of connections made with the several extended heat exchangers 20 described more fully below, and proximal portions 50 of which are shown extending from opposite sides of the combustor.

Each heat exchanger 20 is used for collection of emission products from the several kilns, such as the smoke and other off-gases and particulate matter given off during operation of the kilns, and for preheating such emission products and combustion air for entry and high-temperature, long-dwell combustion in combustor 10.

According to a preferred arrangement, the number of such heat exchangers 20 will vary in number according to the number of emission sources, such as charcoal kilns from which emission products are to be collected, or possible other sources of emission products, and then are drawn by forced circulation into the combustor and therein burned at high temperature and with dwell times long enough for adequately converting the emission products to harmless gases, such as carbon dioxide, water vapor and only negligible amounts of particulate matter. As referred to herein the term "each source of such emission products" means a corresponding collection point, such as a kiln outlet, to which the distal end of a heat exchanger is extended.

Figure 3:
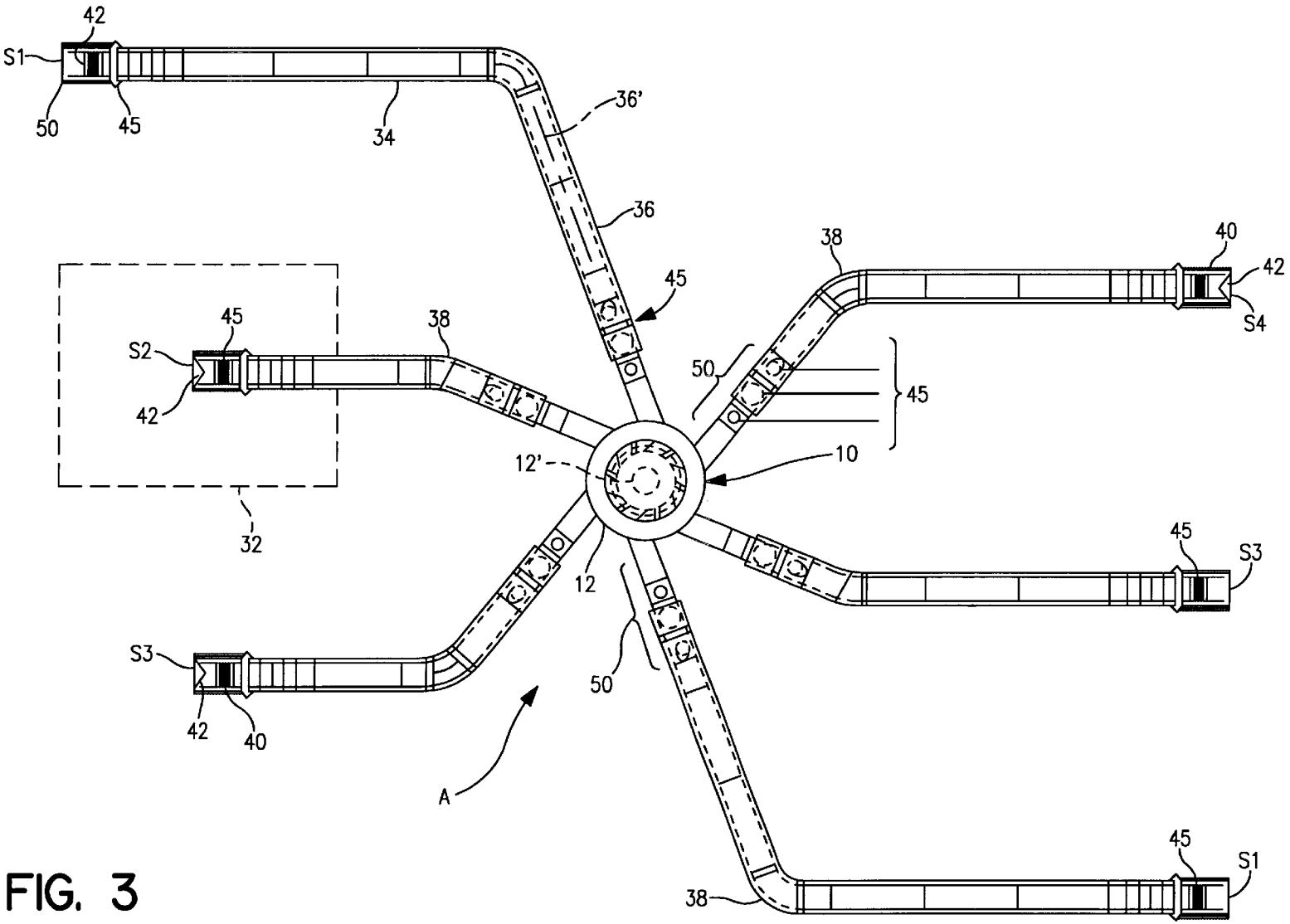
FIG. 3 is a top plan view of the gas combustor system.

As will be appreciated from FIG. 3 that the heat exchangers not only are distributed for providing connection between combustor 10 and each source of emission products but also that each heat exchangers 20 extends preferably over a substantial span of the connection distance between combustor 10 and the several sources of emission products. Most preferably, each heat exchanger extends over the entirety of the connection distance, meaning substantially the entirety of the span of principal ductwork communicating the emission products from the collection points to combustor 10, regardless of how routed the ductwork is routed. It will thus be evident that a heat exchange relationship begins at the outlet of each kiln whereby gases and other products emitted from the respective kilns begin to undergo further heating as they enter the respective heat exchangers and, as will be seen from the disclosure following, continue to undergo heating up to the point of entry into the combustor, where they are exposed to still higher temperatures for ultimate combustion therein over a compound path, culminating in their discharge from the combustor as hot products of combustion which are used to supply heat to each heat exchanger used to draw emission products into the combustor system.

Proximal portions only of a pair of heat exchangers 20 are evident in FIG. 2. It will be understood from succeeding description that distal ends 40 of the heat exchangers are connected to the charcoal kilns or other emission sources, as by extensions 40*b* to kiln outlets which route the emission products of the several kilns to distal ends 40. Provided atop combustor 10 is a housing extension, i.e., what is termed an upper manifold, 22 to which a number of ducts 24, 26 are connected, only two sets of which are shown for clarity of illustration, so that extension 22 is in effect an upper manifold of the combustor. Duct 24, as will be explained below, is a combustion air (CA) collection duct, thus termed CA collection duct 24. Similarly, duct 26 is an emission products collection duct, termed for convenience smoke collection duct 26.

Other ducts are cut away for clarity of illustration, and make connections to housing 22 at locations as evident at 26' and 24'. Also shown in FIG. 2 is the provision of combustion air butterfly valves 24*v*, herein further referred to as CA valves 24*v*, which regulate the proportion of combustion air drawn into combustor 10.

A gas burner 28 sits atop housing 22. Such burner is used for start-up operation, and if necessary, to introduce additional heat into combustor 10 during its operation. At 16M is illustrated a motor 16M under variable frequency drive control for driving fan 16 at a preselected speed which can be varied according to system requirements.

Referring to FIG. 3, the combustor system is designated in its entirety by reference A. Combustor 10 of the system may be located at a central location within an array of emission sources, such as charcoal kilns, which may be any of various constructions including concrete, steel or masonry. In this view, kilns K1–K6 are represented as emission sources are located at points S1–S6 which thus represent the exhaust or exhaust vent connection made for each of the respective heat exchangers 20 and by means of which emission products such as kiln smoke, including particulates, VOCs and PAHs are collected and drawn into the combustor system shown in FIG. 3. Although the kiln emission sources are not shown in FIG. 3, a phantom shape 32 generally designates one such charcoal kiln as representative of the type of emission sources with which the present combustor system A is illustrated to be used.

Each heat exchanger 20 is an elongated structure and may include various straight lengths such as at 34, 36 and angle or comer sections such as at 38 consistent with connection of each of the sources of emission to combustor 10 in a direct or convenient path, and under circumstances in which a sufficient heat exchanger length will be provided for purposes presently appearing.

Valves 42 optionally may be are located at distal end of each heat exchanger 20 for shutoff locally, by manual operation, or optionally by remote or automatically-initiated operation, when the respective kiln is not in operation so as to avoid drawing in cool, relatively uncontaminated air into the system if emission products are not being released by the respective kiln. Optionally shutoff valves may be installed at the points of kiln outlet connections to duct extensions 40*b*, for example, valves 40*bv* in FIG. 6.

Figure 4:
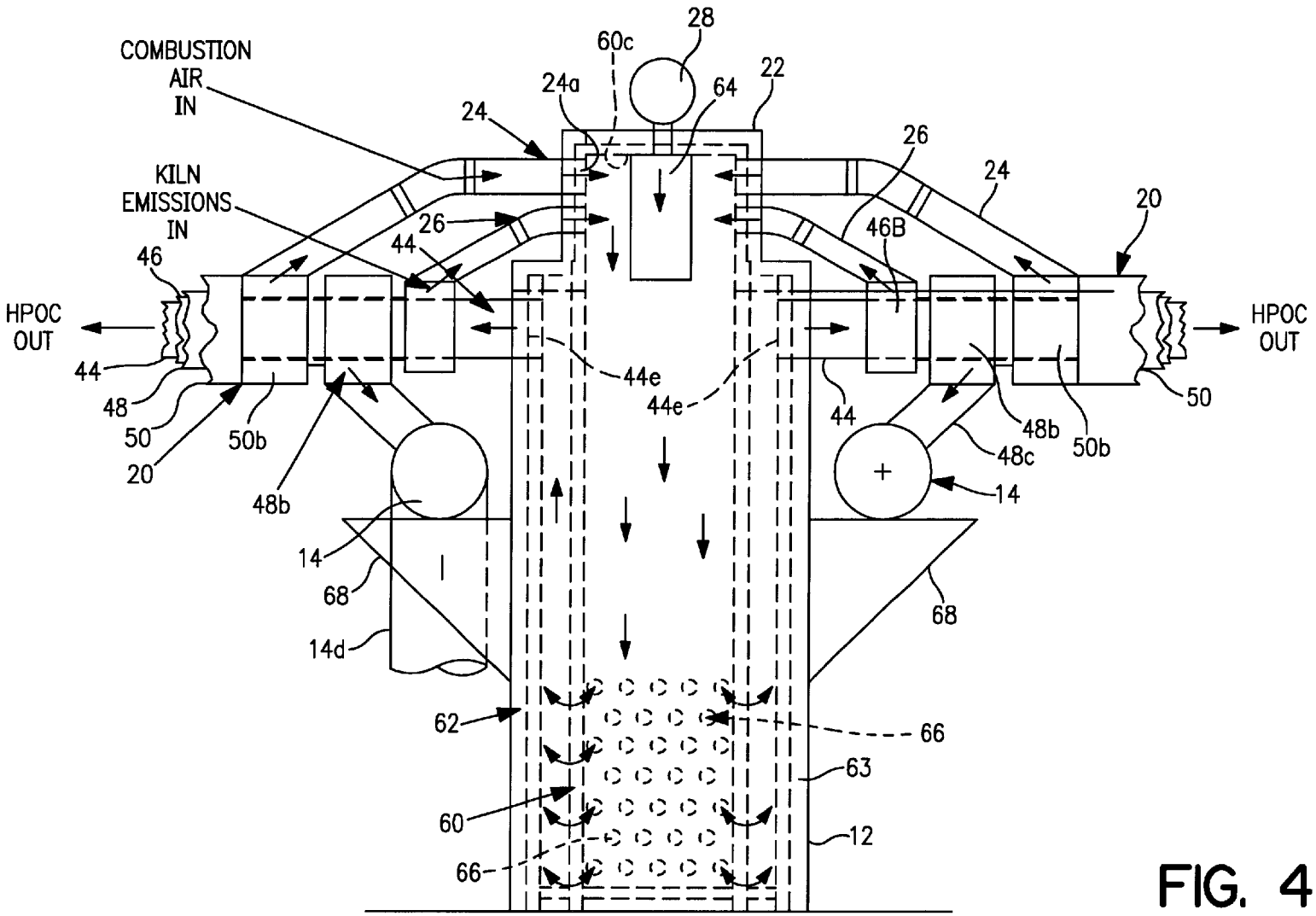
FIG. 4 is a vertical cross section, in schematic form, of the gas combustor illustrated in FIG. 2.
Figure 5:
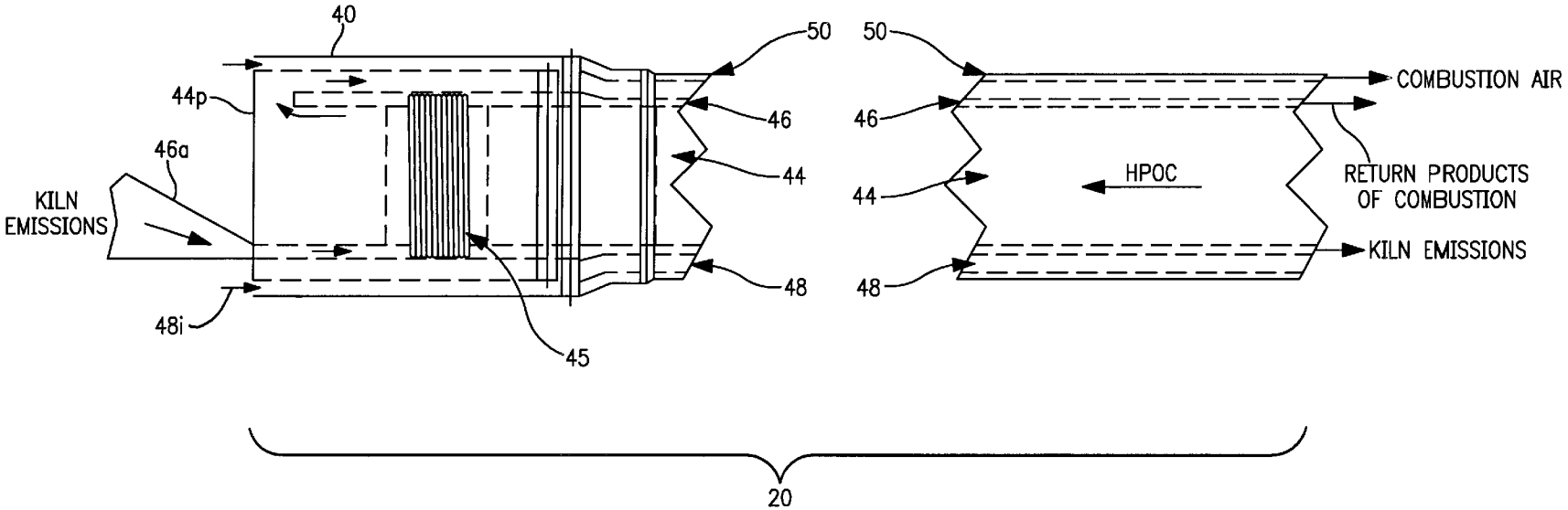
FIG. 5 is a fragmentary side view of portions of a heat exchanger duct of the a combustor system of FIG. 3.

It is seen in FIGS. 2–4 that each heat exchanger 20 is connected at its proximal end to combustor 10. Referring now in particular to FIG. 5, each heat exchanger 20 is shown in greater detail, with sections thereof cut away to show that each heat exchanger comprises four concentric, coaxial ducts formed of suitable material, preferably a stainless steel alloy. Other ducts of the system may also be most preferably of suitable stainless steel alloys but ducts or components not exposed to high temperatures may be of galvanized or other steels or alloys. An innermost duct 44 is termed a hot products of combustion (HPOC) duct, through which hot products of combustion produced by the combustor are delivered through each heat exchanger through the entirety of its length for heat transfer purposes.

Also evident from FIG. 5 is a bellows-type expansion joint 45 at the proximate end to accommodate thermally induced duct expansion in the elongated structures and dimensional changes occurring over the temperature range during operation. HPOC duct 44 is surrounded by an emissions inlet duct, or emission products duct, designated 46, termed for convenience herein a smoke duct, as it will be evident from the following description and drawings that emissions from the charcoal kilns are collected by each smoke duct 46, which thus opens into a fixture 46*a* which connects with collection conduits as designated 46*b* (see FIGS. 1 and 6) extending along the kilns (which may be of various materials, e.g., masonry, concrete or metal) to receive the smoky, gaseous, particle-carrying off-gases of the respective kiln. Heat is transferred from HPOC duct 44 to smoke duct 46 for heating of emission products therein. Various inlet or collection ducts may be provided for routing of emission products to a collection point for entry at the collection point into the distal end of a heat exchanger 20, wherein heating of the emission products is then continuous and unrelenting up to the point of discharge of these products from the heat exchanger into combustor 10.

Coaxially surrounding smoke duct 46 is a return products of combustion (RPOC) duct 48 which communicates at its distal end with HPOC duct 44, which is otherwise closed by an end plate 44*p*. The hot products of combustion, having dropped in temperature cooled to a certain extent by transfer of heat of smoke duct 46 in travelling from combustor 10 to distal end 40, are now referred to as return products of combustion as they reverse direction at distal end 40 and now travel in the reverse direction toward combustor 10, further giving up heat by transferring energy to the emission products within smoke duct 46.

Coaxially surrounding RPOC duct 48 is a combustion air (CA) duct 50 which opens as an intake 48*i* at distal end 40 for intake of fresh air, and through which air for combustion in combustor 10 is taken into the system. As combustion air travels along each heat exchanger, it is heated by transfer of heat from RPOC duct 48 and increases substantially in temperature before entry into combustor 10.

Valves 42 are not shown in FIG. 5, for clarity of illustration.

Referring now again to FIG. 2 and also to FIG. 4, combustor 10 is shown in greater detail. Two heat exchangers 20 are shown connected to combustor 10 but from inspection of FIG. 3 it will be seen that an installation of system A may include several such heat exchangers such as six in the system configured as shown. A greater or lesser number of emission sources may be served by the new combustor system.

At the proximal end of each heat exchanger 20, CA duct 50 communicates with a CA connection 50*b* which thus collects combustion air from CA duct 50 to supply inlet air to upper manifold 22 atop combustor 10 by means of a CA connection duct 24. Similarly an RPOC connection 48*b* receives return products of combustion, providing them by an RPOC connector duct 48*c* (FIG. 2) to RPOC ring 14 which extends circumferentially around combustor housing 12, and from which a ring duct extension 14*d* draws the return products of combustion to fan 16 for ultimate discharge by stack 18. A butterfly valve 48*v* in duct extension 48*c* selectively modulates the volumetric flow rate of return products of combustion from the respective heat exchanger into RPOC ring 14. Fan 16 will thus be seen to provide circulation device at the combustor causing return products of combustion to be drawn from the distal end to the proximal end of each such heat exchanger 20, so as to create a partial pressure within the system for causing emission products to be drawn into the smoke duct at the distal end of the heat exchanger.

A smoke duct connection 46*b* for the emission products drawn in by smoke duct 46 provides the collected emission products, now preheated by the respective heat exchanger, delivering them by smoke connection duct 26 to housing 22 for entry into combustor 10.

A cool air inlet 72 (FIGS. 4 and 6) opens into duct 14*d*, being referred to as a blend air inlet white, to admit cool air for protection of fan 16 against too high an inlet temperature. Speed control of fan 16 regulates the overall volumetric flow rate of the system.

Additionally butterfly valves 24*v* are located in each CA connection duct 24 at a location proximate housing 22 to selectively vary the amount of combustion air drawn in.

Each heat exchanger 20 is connected to the components of combustor 10 in the same manner as described above. With reference again to FIG. 2, the axis of elongation of the proximal portion of each of heat exchangers 20, such as typified by the axis 36' of straight section 36, is preferred to join housing 12 of combustor 10 off-axis from the vertical center line or axis of cylindricity, depicted at 12' (see FIG. 3) of housing 12 so that flow into the several heat exchangers of hot products of combustion, emanating in semitangential orientation from combustor 10, will be facilitated. With reference again to FIG. 3, various other slip joints or expansion joint for the several coaxial ducts, as typical in each heat exchanger 20, are designated in FIG. 3 at 45 and at 47 in FIG. 6.

Referring to FIG. 4, the vertical cross-section of combustor 10 reveals that it comprises a cylindrical inner heating chamber 60 (which may be referred to as inner combustion chamber 60) concentrically surrounded by an outer heating or combustion chamber 62 each formed of so-called castable, by which is meant refractory material which may be shaped by casting and is capable of withstanding high temperatures. Inner heating chamber 60 may be formed of a strong refractory material available under the trade designation VERSAFLOW 60, and may be aluminum and silica-containing low-cement material usable practically to temperatures of about 3100 degrees F. By comparison, outer heating chamber 62 may be of an insulating castable refractory material, such as available under the trade designation GREENLITE-45L insulating material. In place of the VERSAFLOW 60 material, a mullite type low-cement, low-iron refractory material usable practically to about 3200 degrees F. may be used The insulating material forming outer heating chamber 62 retains heat in the combustor. Outer chamber 62 is surrounded by mineral wool board insulating material 63 and a steel outer shell 13.

Atop housing 12 it is seen that upper manifold 22 defines an upper projection of inner heating chamber 60, i.e., upper manifold 22 constitutes an extension of the combustor structure defining inner heating chamber 60 which extension is located above that portion of the structure of combustor 10 which defines outer heating chamber 62. Thus upper manifold 22 provides lateral access to inner heating chamber 60 through its side walls for connection of combustion air and emission inlet ducts 24, 26.

Therefore, and by additional reference to FIG. 3, it may be well appreciated that extension 22 greatly facilitates the advantageous omnidirectional connection of heat exchangers 20, which may accordingly be connected to upper manifold 22 in that peripheral sector corresponding to the proximal connection of the respective heat exchanger 20. That is, at the point of connection to combustor 10 of a heat exchanger 20, it is necessary only to route to and connect to extension 22 the combustion air and smoke inlet ducts 24, 26 of the respective heat exchanger 20. No round-about or circuitous routing is required as the heat exchangers are thus all connected to combustor 10 with azimuthal orientation corresponding to peripheral connection and disposition of the heat exchangers, i.e., in which the heat exchangers extend outwardly from combustor 10 generally in the direction, or at least corresponding logically to the direction, of the respective emission sources they serve and to which they will extend and be connected. Thus, it is to be understood of course, that a charcoal kiln may be located, for example, southwest of combustor 10, and yet the heat exchanger 20 which collects its emission products would extend in a westward direction from the combustor before the heat exchanger routing, as through an elbow, takes the distal end point of connection above a charcoal kiln. But the heat exchanger serving it would not logically have a route of connection on the eastern-most periphery of the combustor. It is also pointed combustor 10 is sufficiently tall that the heat exchangers 20 can extend laterally outwardly toward the above the kilns without having to include elbows for downward or upward extension, and such is an advantage in avoiding any need for addition expansion joints.

Preferably combustor 10 is located preferentially centrally so that it may efficiently receive emission products from an omnidirectional array of heat exchangers 20.

Within inner heating chamber 60, where there is a carburizing atmosphere of combustion products, there is provided a shroud or tubular extension 64, as of high-temperature, corrosion-resistant, special alloy stainless steel, for burner 28, by means of which heat may be introduced into inner heating chamber 60 for startup or in the event of need for additional heat resulting from reduced combustion from a low level of combustible emission products pulled into the system. Burner 28 may be, for example, gas fed and of 4 million BTU rating. Shroud 64 contributes to cyclonic movement of combustion products within the inner chamber and also protects the nozzle of gas burner 28.

Combustion air drawn via ducts 24 enters the upper extent of inner heating chamber 60 at a point just below a ceiling 60*c* of this chamber. Ceiling 60*c* may be formed similarly of castable refractory material. Emission products, i.e., kiln smoke and related constituents, is drawn through ducts 26, into inner heating chamber 60 at a point proximate burner shroud 64 just below the entry ports for the combustion air, so that both combustion air and emission products are directed generally toward and around burner shroud 64 which will be at high temperature if heated by burner 28 and otherwise is at high temperature if combustor 10 is operating with normal throughput. In this regard the combustion air and emission products enter upper manifold 22 with semi-tangential relationship, as noted above, enhancing cyclonic motion and mixing combustion air and emission products for better combustion, and enhances dwell in combustor 10.

It will be understood that for each pair of ducts 24, 26 there are two gas streams of emission products and combustion air which enter the upper end of inner heating chamber 60 for each heat exchanger drawing emission products from a kiln. The streams enter inner heating chamber 60, via respective entry apertures 24*a*, 26*a*, wherein are caused to mix as they enter and are then ignited and undergo further high temperature combustion as they travel downwardly therein as indicated by directional arrows. The path of travel may be cyclonic owing to introduction of the two gas streams off-axis relative to axis 12'. Optionally vanes may be cast into the outer walls of inner heating chamber 60 for further enhancing cyclonic flow. The now heated combustion products flow downwardly toward the closed bottom of inner heating chamber 60 which is provided with a series of regularly spaced apertures 66 opening preferably semitangentially into outer heating chamber 62. The semitangential nature is represented by dotted line depiction of the apertures in FIG. 4, and as also taught in referenced prior application Ser. No. 60/095,054. Apertures are in array preferably occupying approximately the lower third (most preferably about 30%) of the vertical extent of inner heating chamber 60. Representative diameter of apertures 66 is 6.5 in. Most preferably, the total area of apertures 66 is no less than the cross-sectional area of inner chamber 60. The combustion products, now attaining very high temperatures, now pass through apertures 66 into the outer heating chamber 62 in which they pass upward, as indicated by directional arrows. The superheated combustion products, having thus reversed direction, i.e., are moving now upward rather than downward, but continuing cyclonic rotation in the same direction, continue flowing up toward the upper extent of outer heating chamber 62 from which they exit through apertures 44*e* into the several HPOC ducts 44, all as further indicated by directional arrows.

Flow of combustion products, approaching 2000 degrees F., and preferably at least about 1600 to 1700 degrees F., is thus over an overall length of travel which may approach or be greater than about 35–40 ft., and requiring a dwell time, being that time to transit both inner and outer heating chambers 60,62 approaching 2.0 sec. and preferably at least about 1.7 sec. Use of vanes within inner heating chamber 60 and/or outer heating chamber 62 may be made if desired to cause increased rotation of cyclonic flow within the combustor for providing additional dwell time. Thus, dwell times might be varied according to the emission products to be combusted.

Many other variations in the design may be employed. For example, inner walls of inner heating chamber 60 or outer heating chamber 62 may be shaped in selective ways, as for example, by tapering, staggering, and for control of rate of flow within sections. These chambers may be designed to be other than cylindrical, and their height may be varied from that shown in the drawings.

Various refractor materials other than those described herein may be employed.

In each heat exchanger, the hot products of combustion entering HPOC duct 44 travel the length of the heat exchanger, transferring their thermal energy through the duct walls to smoke duct 46. The combustion products then reverse direction at the distal end of the heat exchanger and continue to transfer heat to smoke duct during return travel through RPOC duct 48.

The returning combustion products, having now been cooled substantially, are drawing by fan 16 into RPOC ring 14, serving as a plenum, and thence into fan 16 which discharges them harmlessly to ambient atmosphere upward through stack 18.

It is accordingly found that emission products of the type emanating from charcoal kilns are readily combusted at sufficient temperature and dwell time to effectively render them safe for vertical discharge to the ambient atmosphere.

As an alternative to direct discharge, the combustion products may be directed to other uses, such as further treatment, or may be supplied for drying of products, premises heating, water heating, or driving other processes or devices, or supplied to heat exchangers requiring a source of thermal energy.

Control of temperatures and pressures can be maintained by variable speed fan 16 and by establishing proper settings of RPOC valve 48*v* (FIG. 2) and CA valves 24*v* (FIG. 2). Also provided at a location designated 72 in FIG. 6 (and not shown in FIG. 2 or FIG. 4) is a blend air inlet, with which is associated an electrically actuated damper 72*d* of which may be configured by those skilled in the art to allow selective control of blend air into combustor 10. Blend air inlet 72 opens into outer beating chamber 62. Blend air inlet 72 may thus be selectively opened according to need for proportional increase in the amount of blend air introduced into combustor 10 to achieve proper maintenance of combustion temperature and to regulate temperature of hot products of combustion directed from combustor 10 into heat exchangers 20.

Operation of the system using the foregoing control elements is carried out by a control system using microprocessor-driven controls using PLC (programmable logic controller) modules for establishing and maintaining proper negative pressure for optimum draft control while maintaining the correct amount of air and temperature for combustion in inner heating chamber 60 and outer heating chamber 62, as according to preferred operating temperatures preselected for proper operation of combustor 10 and combustor system A as a whole. Such controls and features may be in accordance with above-referenced patent application Ser. No. 60/095,054 filed Aug. 3, 1998. These control circuits of the system include one or more thermocouples for monitoring temperature in inner heating chamber 60 and at appropriate discharge points. So also the system monitors the temperature to determine if there is need to fire burner 28, as during start-up or during very low levels of emission products for combustion. In practical use, it is found that the combustor system is capable of stable, self-sustained operation when drawing adequate emission products, without use of burner 28.

Figure 6:
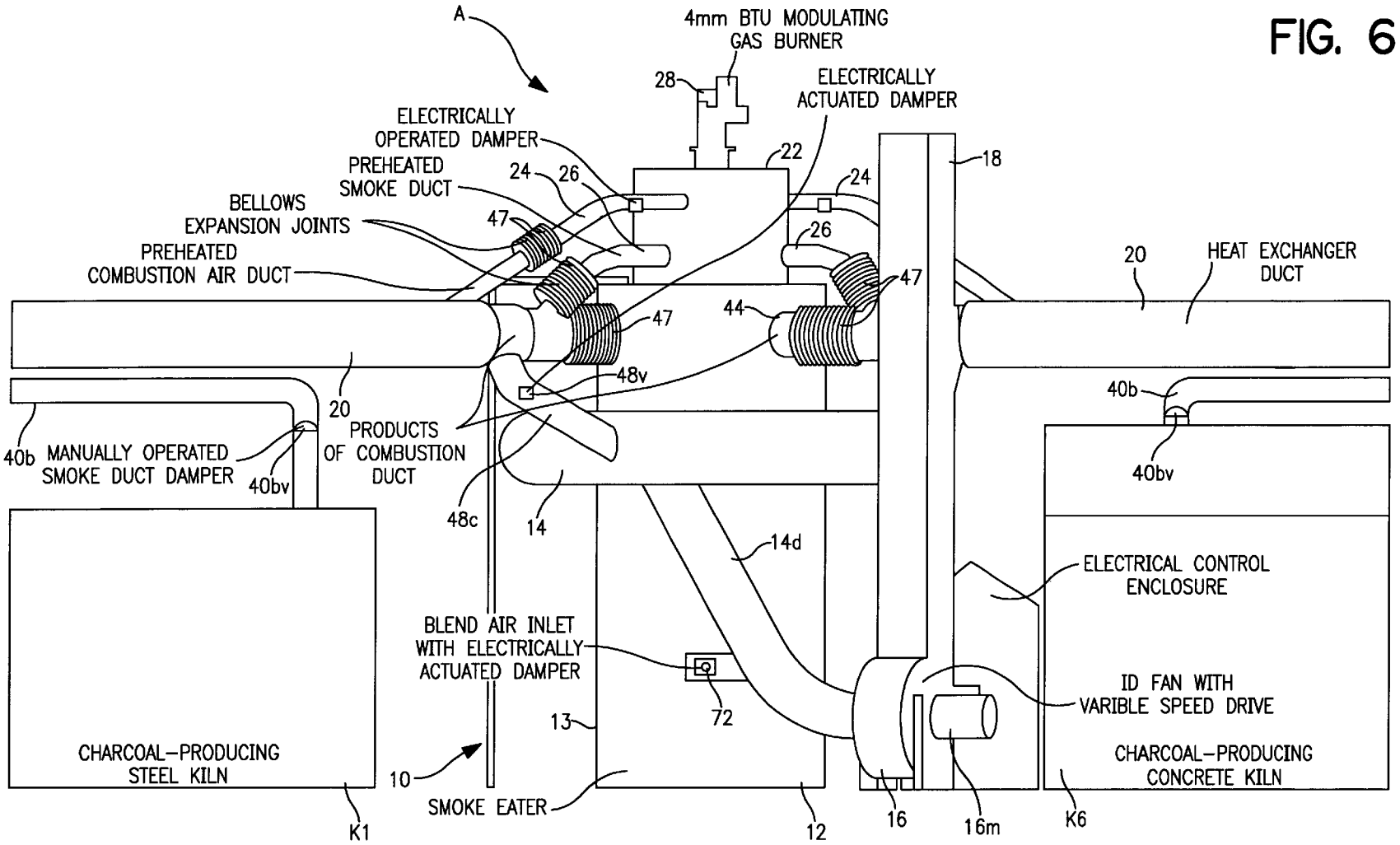
FIG. 6 is a vertical elevation of a combustor forming part of the combustor system of FIG. 1, virtually depicting elements of the combustor system, and showing a certain blend air inlet which is fitted with an electrically actuated damper, and more clearly revelatory of actual features.

Referring to FIG. 6, the features of the new combustor system and combustor 10 are more clearly illustrated. Although not shown in earlier drawing figures for simplicity of illustration, apparent in FIG. 6 are bellows-type expansion joints 24*j*, 26*j* in ducts 24, 26 and bellows-type expansion joints 44*j* for the HPOC ducts 44. These several expansion joints accommodate thermally induced duct expansion in the elongated structures and dimensional changes occurring over the temperature ranges experienced during normal operation. In this regard, elements of the combustor system are exposed to a wide range of temperatures from start-up at normal ambient temperatures to typically, for some elements, a maximum temperatures not substantially more than 2000 degrees F.

EXAMPLE 1

A practical combustor system having a combustor configured generally in accordance with the illustrations shown for combustor 10 is constructed using materials and features described above. It has representative dimensions as follows: Housing 12 has an overall height of about 27 ft., not including additional vertical projection of burner 28. Apertures 66 occupy about 30% of the lower third of inner heating chamber 60. Representative The diameter of apertures 66 is 6.5 in., as compared to a representative inside diameter of about 5 ft. for inner heating chamber 60 and an outer diameter of about 10 ft. for housing 12. The spacing between the inner wall of outer heating chamber 62 and outer wall of inner heating chamber 60 representatively may exceed 1 ft. Wall thickness of the inner and outer heating chambers may be of the order of 0.5 ft. The overall height of the outside walls of outer heating chamber 62 may be about 22 ft. Typical length of any of heat exchangers 20 may be at least about 20 ft. and may reach a practical maximum length of from about 80 to about 100 ft. RPOC ring 14 may be slightly greater than 3 ft. in tubing diameter, and the ring may be supported on triangular brackets 68 as depicted generally in FIG. 4. Operation of combustor 10 experimentally at a charcoal kiln site with kilns emitting smoky emission at a temperature of about 450 to 500 degrees F. shows that temperatures within the heating chambers approaches 1700 degrees F. and may be operated safely to 2000 degrees F. Flow is adjusted to produce an average dwell time for emission products undergoing combustion of greater than or equal to 1.7 sec. Resultant operation shows that at least 99% of VOCs are burned and discharge levels of carbon monoxide are 30 ppm or even substantially less or nil. Negligible, safe amounts of particulate matter of a size PM10 are released.

In view of the foregoing description of the present invention and practical embodiments it will be seen that the several objects of the invention are achieved and many other advantages are attained.

As various modifications could be made in the constructions and methods herein described and illustrated without departing from the scope of the invention, it is intended that all matter contained in the foregoing description or shown in the accompanying drawings shall be interpreted as illustrative rather than limiting. The breadth and scope of the present invention should not be limited by any of the above-described exemplary disclosure, but rather should be defined only in accordance with the claims appended hereto and their equivalents.

What is claimed is:

1. A combustor system for high temperature, high-dwell combustion of emission products by connection to at least one source of emission products, comprising:

a combustor defining an internal combustion chamber for combustion of emission products, an inlet for receiving emission products to be combusted in the chamber, and a hot products of combustion outlet for providing outward flow of hot products of combustion from the combustion chamber, at least one of permissible multiple heat exchangers connected to the inlet, the heat exchangers corresponding to each source of such emission products, and extending between the combustor and source of emission products for providing connection between the combustor and each source of emission products, each of the heat exchangers having a proximal end for connection to the combustor and a distal end for connection to a source of emission products, each such heat exchanger comprising multiple ducts in mutual heat exchange relationship including at least:

a hot products of combustion duct for receiving at the proximal end hot products of combustion from the hot products of combustion outlet, and conveying the hot products of combustion to the distal end, an emissions inlet duct for receiving emission products at the distal end from the source of emission products, and a return products of combustion duct for receiving at the distal end the hot products of combustion and returning them to the combustor, such that the hot products of combustion duct and the return products of combustion duct cause heating of the emission products by said heat exchange relationship, a combustion air intake passage for providing intake of combustion air for introduction into the combustion chamber for mixing therein with the emission products provided by the emission products duct to provide mixed combustion products into the combustion chamber for high temperature combustion therein, the combustor being configured for flow of combustion products passing therein to create hot products of combustion, a circulation means to create a partial pressure within the system for causing emission products to be drawn into the emission inlet duct at the distal end from the source of emission products, and for causing drawing into the system combustion air, means for exhausting the return products of combustion after they have flowed through each such heat exchanger.

2. A combustor system as set forth in claim 1 wherein each heat exchanger extends over a substantial span of the connection distance between combustor and the respective sources of emission products, and extend omnidirectionally from the combustor in directions corresponding logically to locations of the sources of emission products.

3. A combustor system as set forth in claim 2 wherein the combustor system is configured for installation at a charcoal production facility having multiple charcoal kilns representing a multiple sources of emission products, and wherein the combustor is centrally located for receiving emission products from each such source, the combustor and sources being connected by respective heat exchangers.

4. A combustor system as set forth in claim 1 wherein the circulation means is a variable speed fan and a plenum in which partial pressure is developed by the fan for drawing return products of combustion from each heat exchanger.

5. A combustor system as set forth in claim 4 wherein the plenum is a collector ring encircling the combustor, and the fan draws return products of combustion from the ring.

6. A combustor system as set forth in claim 1 the combustion air intake passage is a combustion air duct in mutual heat exchange relation with at least the return products of combustion duct and extends extending between the combustor and source of emission products.

7. A combustor system as set forth in claim 6 wherein the combustion air duct, the hot products of combustion duct, the emissions inlet duct and the return products of combustion duct are coaxial.

8. A combustor system as set forth in claim 1 wherein the combustor comprises multiple interconnected gas heating chambers, a first of said chambers providing said inlet for receiving emission products to be combusted in the chamber, and a second of said chambers having said hot products of combustion outlet, wherein emission products enter the first chamber and combustion products exit the second chamber.

9. A combustor system as set forth in claim 8 wherein the internal combustion chamber comprises coaxial inner and outer combustion chambers constituting the first and second chambers, respectively, combustion products passing through the first chamber into the second chamber with reversal of direction.

10. A combustor system as set forth in claim 9 wherein the inner and outer chambers are in coaxial relationship, said inlet and exit each being at one end of the respective inner and outer chambers, the inner chamber communicating with the outer chamber at an opposite end of the inner and outer chambers, whereby combustion products pass through the first chamber into the second chamber with reversal of direction in counterflow relation.

11. A combustor system as set forth in claim 10 wherein multiple apertures in an array open extending circumferentially and semitangentially from the inner combustion chamber to the outer combustion chamber over a predetermined portion of the length of the inner combustion chamber, the apertures having a total area not less than a transverse cross-sectional area of the inner chamber.

12. A combustor system as set forth in claim 11 wherein the predetermined mutual portion constitutes about one-third of the length of the inner combustion chamber.

13. A combustor system as set forth in claim 12 wherein the inner and outer chambers are vertical, the inlet and exit each being at an upper end of the respective inner and outer chambers.

14. A combustor system as set forth in claim 10 wherein the heat exchangers extend omnidirectionally from the combustor in directions corresponding logically to locations of the sources of emission products to which the heat exchangers are connected.

15. A combustor system as set forth in claim 14 wherein the inner combustion chamber extends upwardly beyond the outer combustion chamber within a upper manifold providing omnidirectional connection of such heat exchangers for supplying emission products to the inner combustion chamber with azimuthal orientation corresponding to omnidirectional connection of the heat exchangers to the combustor.

16. A combustor system as set forth in claim 10, further comprising an auxiliary burner for supplying heat to the inner combustion chamber for initiating combustion therein and optionally for maintaining combustion therein when needed.

17. A combustor system as set forth in claim 10 wherein the inner and outer combustion chambers are formed of castable refractory material, the castable material forming the outer chamber being of insulating type.

18. A combustor system for high temperature, high-dwell combustion of emission products by connection to multiple sources of emission products, comprising a combustor defining an internal combustion chamber for combustion of emission products, an inlet for receiving emission products to be combusted in the chamber, and a hot products of combustion outlet for providing outward flow of hot products of combustion from the combustion chamber, a plurality of heat exchangers each connected to the inlet, each heat exchanger being connected to at least one source of such emission products, and extending between the combustor and source of emission products for providing connection between the combustor and each source of emission products, the heat exchanger having a proximal end for connection to the combustor and a distal end for connection to the a source of emission products, each such heat exchanger comprising multiple ducts in mutual heat exchange relationship including at least a hot products of combustion duct for receiving at the proximal end hot products of combustion from the hot products of combustion outlet, and conveying the hot products of combustion to the distal end, an emissions inlet duct for receiving emission products at the distal end from the source of emission products, and a return products of combustion duct for receiving at the distal end the hot products of combustion and returning them to the combustor, such that the hot products of combustion duct and the return products of combustion duct cause heating of the emission products by said heat exchange relationship, a combustion air intake passage for providing intake of combustion air for mixing in the combustion chamber with the emission products provided by the emission products duct to provide mixed combustion products into the combustion chamber for high temperature combustion therein, the combustor being configured for flow of combustion products passing therein to create hot products of combustion, a circulation means to create a partial pressure within the system for causing emission products to be drawn into the emission inlet duct at the distal end from the source of emission products, and means for exhausting the return products of combustion after they have flowed through each such heat exchanger.

19. A combustor system for high temperature, high-dwell combustion of kiln emission products of multiple charcoal kilns, a combustor defining an internal combustion chamber for combustion of kiln emission products, an inlet for receiving the kiln emission products to be combusted in the chamber, and a hot products of combustion outlet for providing outward flow of hot products of combustion from the combustion chamber, a plurality of heat exchangers each connected to the inlet, each heat exchanger being connected to at least one or the kilns, and extending between the combustor and source of kiln emission products for providing connection between the combustor and the respective kilns, the heat exchanger having a proximal end for connection to the combustor and a distal end for connection to the respective kilns, each such heat exchanger comprising multiple ducts in mutual heat exchange relationship including at least a hot products of combustion duct for receiving at the proximal end hot products of combustion from the hot products of combustion outlet, and conveying the hot products of combustion to the distal end, an emissions inlet duct for receiving kiln emission products at the distal end from the respective kilns, and a return products of combustion duct for receiving at the distal end the hot products of combustion and returning them to the combustor, such that the hot products of combustion duct and the return products of combustion duct cause heating of the kiln emission products by said heat exchange relationship, a combustion air intake passage for providing intake of combustion air for mixing with the kiln emission products in the combustion chamber provided by the emission products duct to provide mixed combustion products into the combustion chamber for high temperature combustion therein, the combustor being configured for flow of combustion products passing therein to create hot products of combustion, a circulation means to create a partial pressure within the system for causing kiln emission products to be drawn into the emission inlet duct at the distal end from the respective kilns, and means for exhausting the return products of combustion after they have flowed through each such heat exchanger.

20. A combustor system as set forth in claim 19 wherein the heat exchangers extend omnidirectionally from the combustor in directions corresponding generally to locations of the sources of emission products to which the heat exchangers are connected.

* * * * *